US010967645B2

(12) United States Patent
Higuchi et al.

(10) Patent No.: US 10,967,645 B2
(45) Date of Patent: Apr. 6, 2021

(54) RECORDING APPARATUS

(71) Applicant: SEIKO EPSON CORPORATION, Tokyo (JP)

(72) Inventors: Tomoyuki Higuchi, Shiojiri (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/782,780

(22) Filed: Feb. 5, 2020

(65) Prior Publication Data

US 2020/0247135 A1 Aug. 6, 2020

(30) Foreign Application Priority Data

Feb. 6, 2019 (JP) ..... JP2019-019515

(51) Int. Cl.
*B41J 2/175* (2006.01)

(52) U.S. Cl.
CPC ..... *B41J 2/17566* (2013.01); *B41J 2/17509* (2013.01); *B41J 2/17546* (2013.01)

(58) Field of Classification Search
CPC ..... B41J 2/17566; B41J 2/17509; B41J 2/17553; B41J 2/17506; B41J 29/393; B41J 2/17546; B41J 2/175
See application file for complete search history.

(56) References Cited

U.S. PATENT DOCUMENTS

2014/0104347 A1* 4/2014 Iizawa ..... B41J 2/17513 347/85

FOREIGN PATENT DOCUMENTS

JP 2004-142325 5/2004

* cited by examiner

*Primary Examiner* — Julian D Huffman
(74) *Attorney, Agent, or Firm* — Workman Nydegger

(57) ABSTRACT

A recording apparatus includes a main unit that accommodates a recording head and a carriage that is movable in a transport direction of the medium. At least one liquid container mounted above the recording head in the carriage contains the liquid to be supplied to the recording head and has an inlet through which the liquid is to be refilled from an ink refill bottle. The plug member plugs up the inlet. An illumination member irradiates the liquid container from the liquid container. A detector detects detaching of the plug member from the inlet. A controller controls the illumination member, based on a detection result of the detector. The illumination member irradiates the liquid container in response to detection of the detaching of the plug member from the inlet with the detector.

6 Claims, 6 Drawing Sheets

RECORDING APPARATUS

The present application is based on, and claims priority from JP Application Serial Number 2019-019515, filed Feb. 6, 2019, the disclosure of which is hereby incorporated by reference herein in its entirety.

BACKGROUND

1. Technical Field

The present disclosure relates to recording apparatuses.

2. Related Art

Ink jet printers, which are one example of recording apparatuses, include: a recording head that performs a recording operation by discharging ink onto a paper sheet called a medium; and a liquid container that contains the ink to be supplied to the recording head. Some ink jet printers have a refillable liquid container, in which the ink to be consumed by the recording operation can be refilled. For example, JP-A-2004-142325 discloses an ink jet printer that includes: a transparent liquid container; and a transparent window provided on a portion of the exterior. This configuration enables a user to visually check the remaining amount of ink in the liquid container through the window.

The disclosed ink jet printer may be disadvantageous in that the user has trouble finding the inlet of the liquid container when refilling the ink in the liquid container.

SUMMARY

According to an aspect of the present disclosure, a recording apparatus includes a recording head that performs a recording operation by discharging a liquid onto a medium. A carriage that is movable in a direction intersecting a direction in which the medium is to be transported and that has a bottom on which the recording head is mounted. At least one liquid container that contains the liquid to be supplied to the recording head and that has an inlet through which the liquid is to be refilled from an ink refill bottle is mounted above the recording head in the carriage. A plug member plugs up the inlet. An illumination member irradiates the liquid container from the liquid container. A detector detects detaching of the plug member from the inlet. A controller controls the illumination member, based on a detection result of the detector. The illumination member is configured to irradiate the liquid container in response to detection of the detaching of the plug member from the inlet with the detector.

In the above recording apparatus, the illumination member may emit a light ray, a color of which is related to a color of the liquid contained in the liquid container.

In the above recording apparatus, the illumination member may operate in a lighting state that depends on a remaining amount of the liquid contained in the liquid container.

In the above recording apparatus, the main unit may have a liquid amount checker for use in checking the remaining amount of the liquid contained in the liquid container.

In the above recording apparatus, the liquid amount checker may include a second illumination member that operates in a lighting state that depends on the remaining amount of the ink.

In the above recording apparatus, the liquid amount checker may be formed of a transparent member that enables the remaining amount of the liquid to be visually checked.

DESCRIPTION OF EXEMPLARY EMBODIMENTS

First Embodiment

With reference to the accompanying drawings, a description will be given below in detail of a recording apparatus according to some embodiments of the present disclosure. In one embodiment, an ink jet printer 1, abbreviated below as a printer 1, is an example of the recording apparatus.

Figure 1:
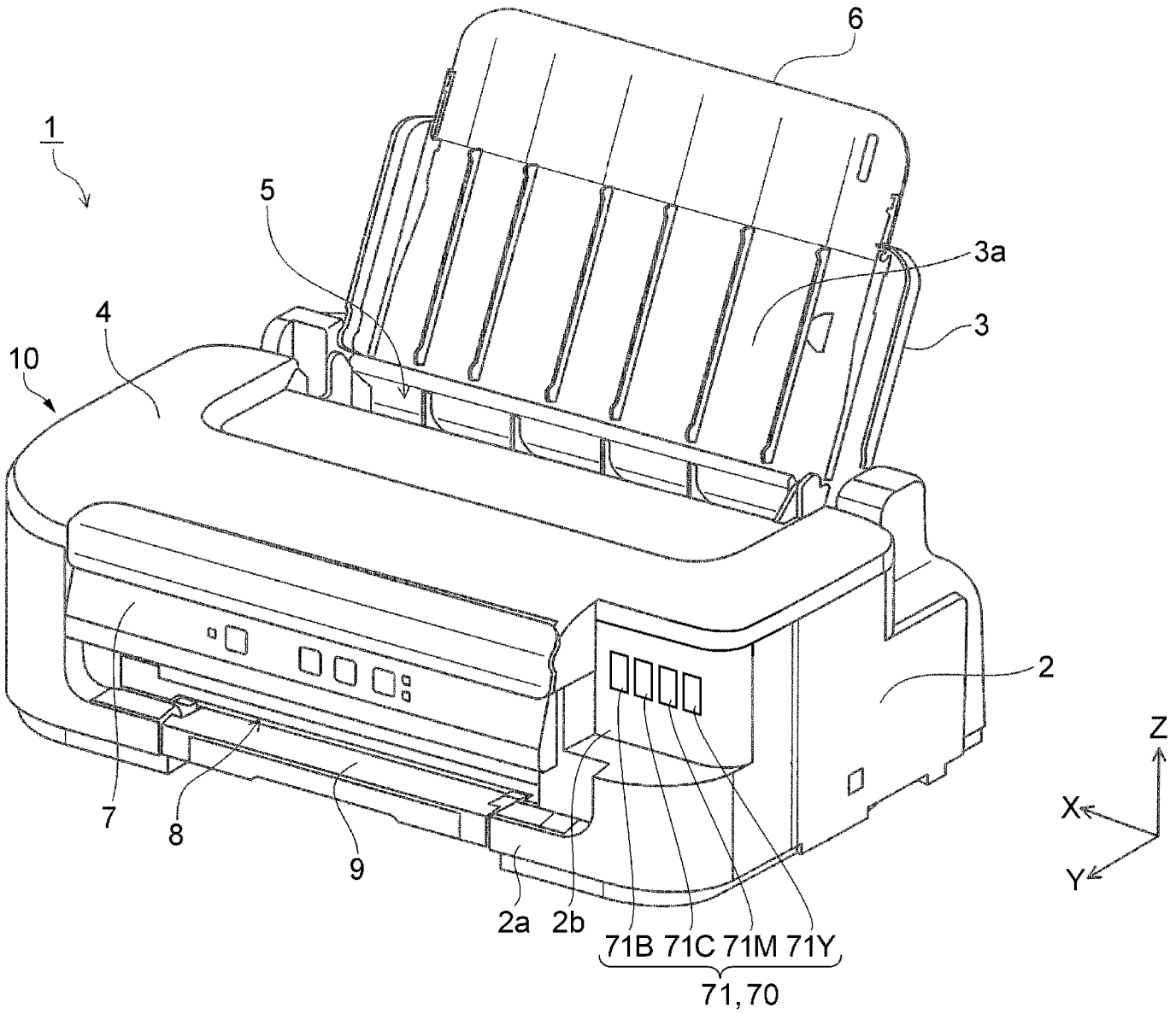
FIG. 1 illustrates, in perspective, the exterior of a printer according to a first embodiment of the present disclosure.
Figure 2:
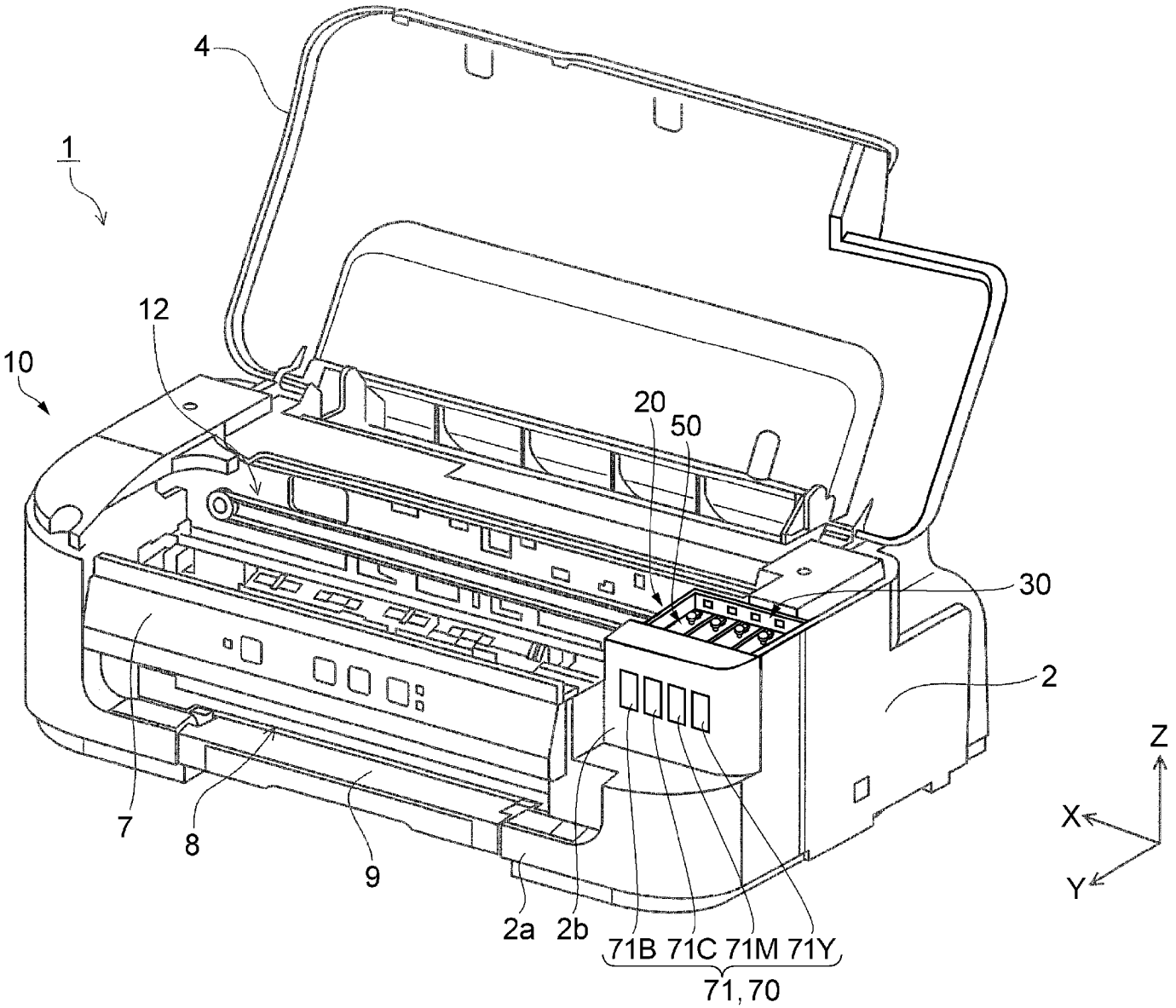
FIG. 2 illustrates the printer in perspective, with its upper cover open.
Figure 3:
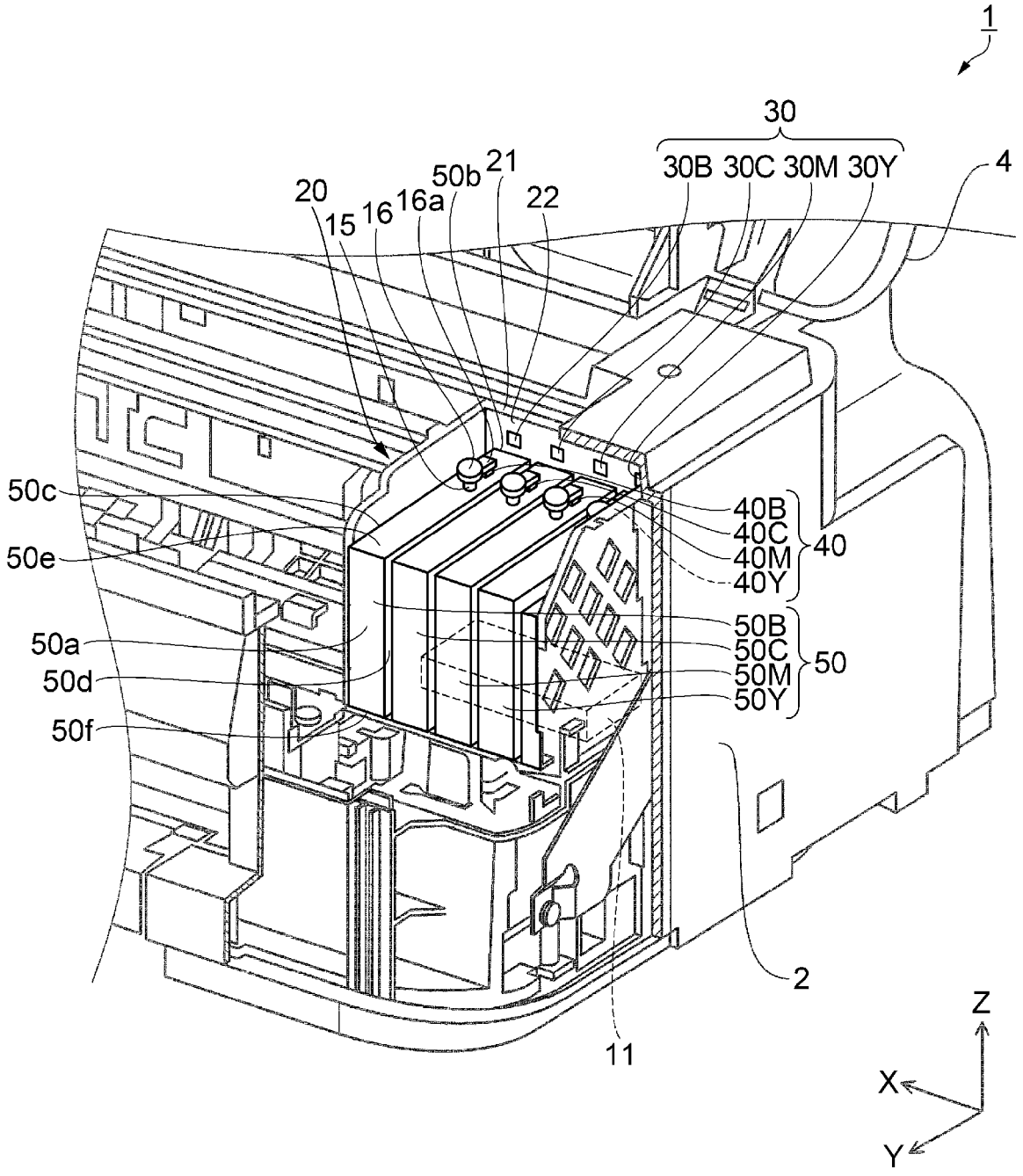
FIG. 3 illustrates a key part of the printer in perspective and in an enlarged manner, with its housing partly removed.
Figure 4:
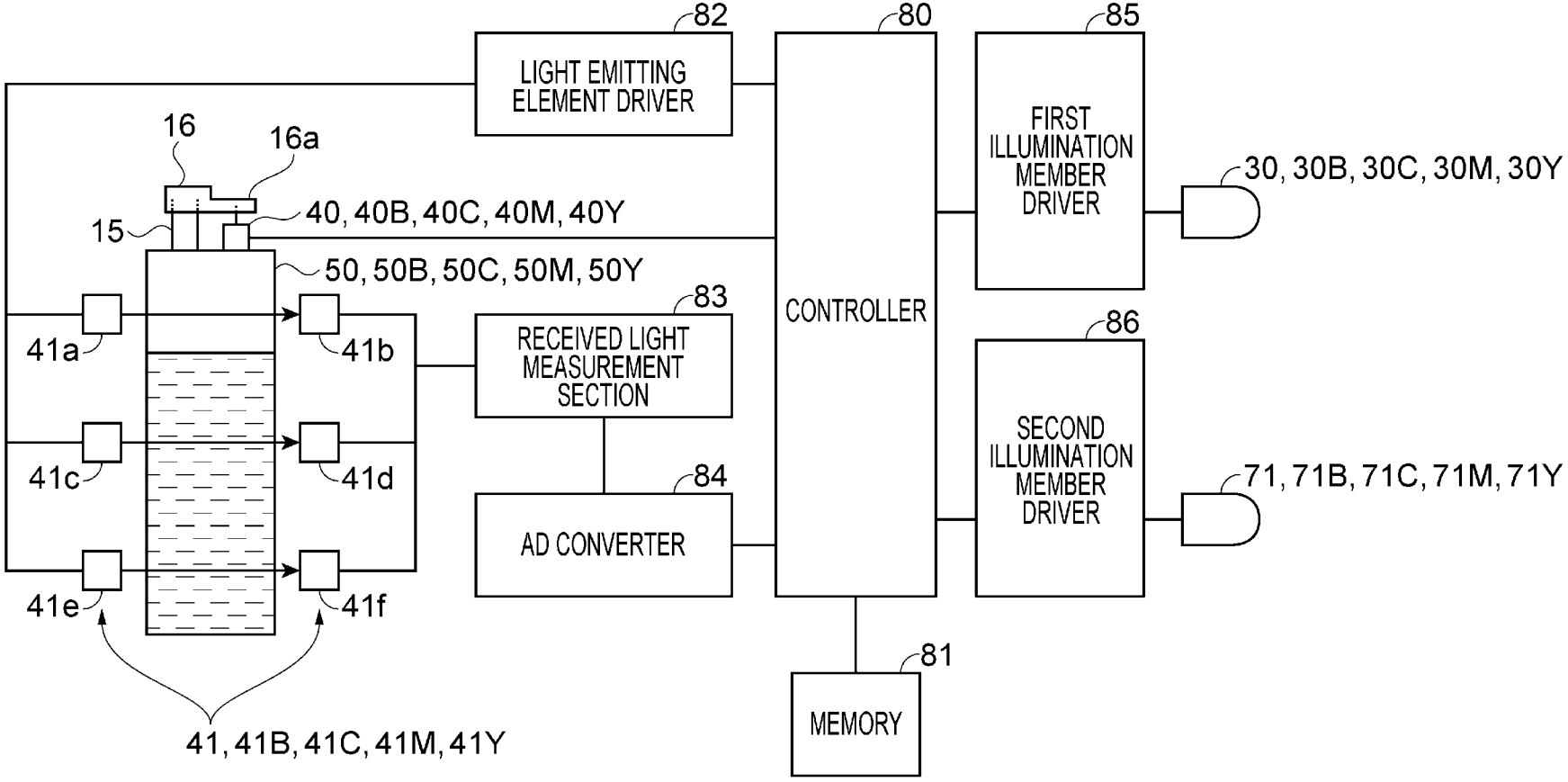
FIG. 4 is a schematic block diagram of a sensor-related circuit of the printer.
Figure 5:
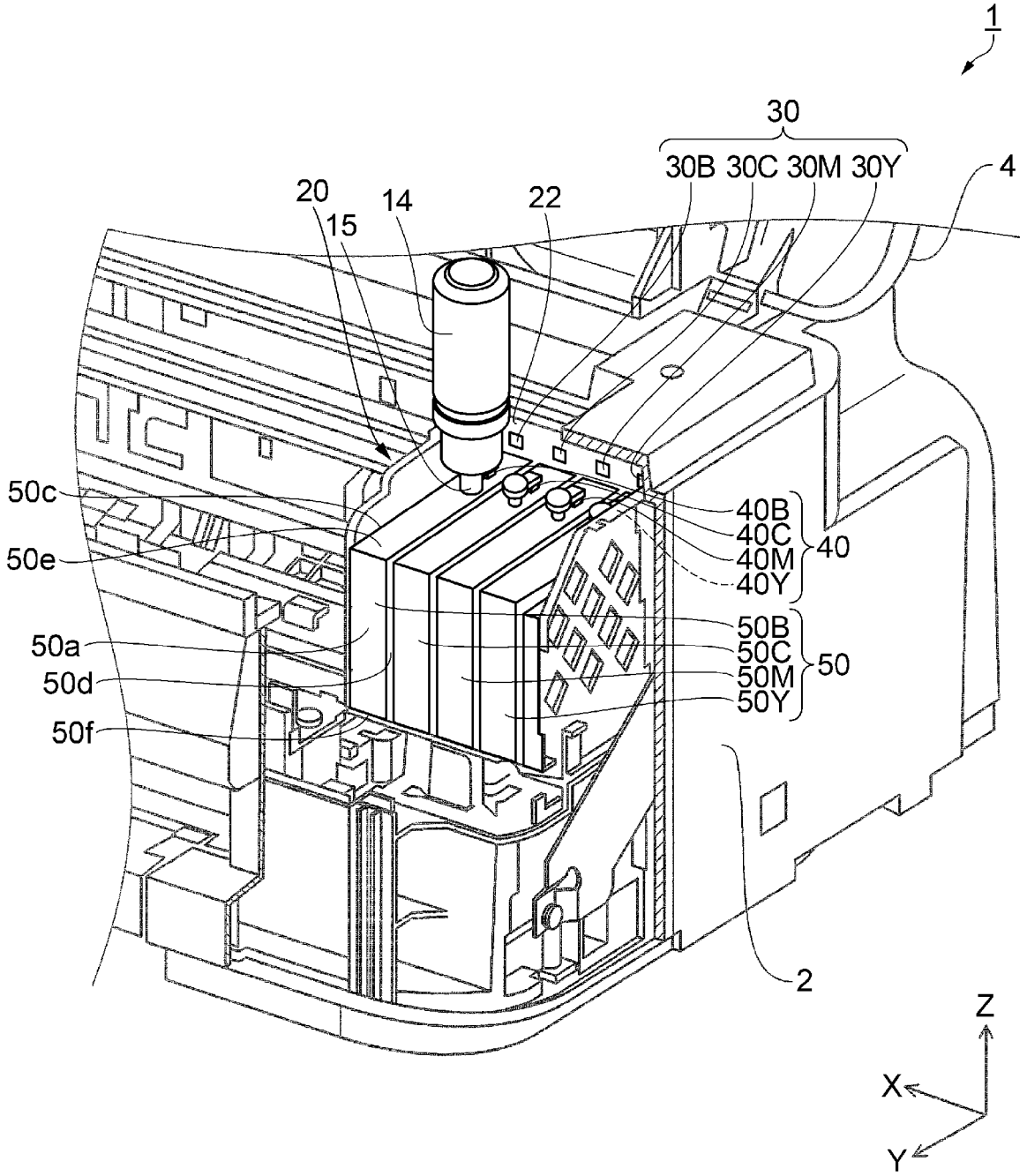
FIG. 5 illustrates an ink refill bottle attached to the inlet of the ink tank, in perspective.

FIG. 1 illustrates the exterior of the printer 1 in perspective, with a supply tray 3 placed in an upright position. FIG. 2 illustrates the printer 1 in perspective, with an upper cover 4 open. FIG. 3 illustrates a key part of the printer 1 in perspective and in an enlarged manner, with a housing 2 partly removed. FIG. 4 is a schematic block diagram of a sensor-related circuit of the printer 1. FIG. 5 illustrates, in perspective, an ink refill bottle 14 attached to an inlet 15 of an ink tank 50.

Each of the drawings employs an X-Y-Z coordinate system. The X axis extends along the width of the printer 1; the Y axis extends along the depth of the printer 1; and the Z axis extends along the height of the printer 1. The front surface of the printer 1 is oriented toward the positive side (+Y) of the Y axis, whereas the back surface of the printer 1 is oriented toward the negative side (−Y) of the Y axis. When the printer 1 is viewed from the front, the left surface is oriented toward the positive side (+X) of the X axis, whereas the right surface is oriented toward the negative side (−X) of the X axis. The upper surface of the printer 1 is oriented toward the positive side (+Z) of the Z axis, whereas the lower surface of the printer 1 is oriented toward the negative side (−Z) of the Z axis.

As illustrated in FIG. 1, the exterior of the printer 1 includes: the housing 2 having a recording head 11 (see FIG. 3) inside as a recording unit; a supply tray 3 pivotable around an unillustrated axis on the back surface of the housing 2; and the upper cover 4 covering an upper portion of the housing 2. Herein, the structure surrounded by the housing 2 is referred below as a main unit 10.

When the supply tray 3 is placed in an upright position as illustrated in FIG. 1, a supply port 5 provided in the upper portion of the housing 2 is exposed to the outside. The supply port 5 can accommodate some paper sheets or other media. The supply tray 3 exposes or covers an upper region, containing the supply port 5, of the housing 2. As can be seen from FIG. 1, the supply tray 3 slightly inclines when being placed in the upright position, and thus can support paper sheets or other media inserted into the supply port 5 with a support surface 3*a*.

The supply tray 3 has an auxiliary supply tray 6 that is slidable and insertable into the supply tray 3. If the auxiliary supply tray 6 is pulled out as illustrated in FIG. 1, the supply tray 3 can support longer paper sheets stably.

When being inserted into the supply port 5, a paper sheet is transported into the main unit 10 in the +Y direction by an unillustrated transport mechanism. Then, this paper sheet is subjected to the recording or print operation by the recording head 11 provided inside the main unit 10. After that, the paper sheet is ejected to the outside through an ejection section 8 provided on a front surface 2*a* of the housing 2.

When the upper cover 4 is pivoted upward as illustrated in FIG. 2, the interior of the main unit 10 is exposed. The main unit 10 contains a carriage 20 having the recording head 11 that performs the recording operation by discharging ink or other liquid onto a paper sheet. The recording head 11 is provided on the bottom of the carriage 20 which is oriented in the −Z direction. It is to be noted that the recording head 11 is not illustrated in FIG. 2.

The carriage 20 is movable, by a belt conveyer mechanism 12, along the width of the printer 1 which intersects the transport direction of a paper sheet, namely, along the X axis intersecting the +Y direction. The movable region of the carriage 20 is covered with the upper cover 4.

As illustrated in FIG. 3, the carriage 20 has a carriage case 21 that accommodates a plurality of ink tanks 50. Each of the ink tanks 50 serves as a liquid container that contains the ink or other liquid to be supplied to the recording head 11. The ink tanks 50 are mounted inside the carriage case 21 of the carriage 20 above the recording head 11. In one embodiment, four ink tanks 50 may be used, as illustrated in FIG. 3, and the respective ink tanks 50 may contain black, cyan, magenta, and yellow inks.

As illustrated in FIGS. 1 and 2, the front surface 2*a* of the housing 2 is provided with an operation panel 7, which is used to operate the printer 1. The operation panel 7 is disposed above the ejection section 8, which is provided with an ejection tray 9 that can be pulled out.

When the front surface 2*a* of the main unit 10 is viewed from the front, a second front surface 2*b* is disposed in an upper right portion of the front surface 2*a*. The second front surface 2*b* is recessed toward the interior of the main unit 10 and substantially parallel to front surfaces 50*a* (see FIG. 3) of the ink tanks 50 amounted in the carriage 20, details of which will be described later. The upper cover 4 is notched at one corner in conformity with the shape of the second front surface 2*b*, so that the user can easily view an ink amount checker 70, details of which will be described later.

The second front surface 2*b* is provided with the ink amount checker 70 for use in checking the remaining amounts of the inks contained in the ink tanks 50. In one embodiment, the ink amount checker 70 may include four second illumination members 71 that operate in lighting states in accordance with the remaining amounts of the inks. Each of the second illumination members 71 may be a light emitting diode (LED) arranged in any given fashion on the second front surface 2*b*. In one embodiment, four LEDs may be arrayed at predetermined intervals along the X axis.

The second illumination members 71 include second illumination members 71B, 71C, 71M, and 71Y in relation to the colors of the inks used in the printer 1. More specifically, the second illumination member 71B is provided for the black ink; the second illumination member 71C is provided for the cyan ink; the second illumination member 71M is provided for the magenta ink; and the second illumination member 71Y is provided for the yellow ink. When the second front surface 2*b* is viewed from the front, the second illumination member 71B for the black ink, the second illumination member 71C for the cyan ink, the second illumination member 71M for the magenta ink, and the second illumination member 71Y for the yellow ink are arranged in this order from the left. The arrangement of the second illumination members 71 is related to that of the ink tanks 50 in the carriage 20, details of which will be described later.

In one embodiment, the colors of the light rays emitted from the LEDs that implement the second illumination members 71B to 71Y may be similar to those of the inks. More specifically, the second illumination member 71C for the cyan ink may be an LED that emits blue rays; the second illumination member 71M for the magenta ink may be an LED that emits orange rays; and the second illumination member 71Y for the yellow ink may be an LED that emits yellow rays. Exceptionally, the second illumination member 71B for the black ink may be an LED that emits white rays. The manner in which the second illumination members 71B to 71Y operate in accordance with the remaining amounts of the inks will be described later.

In one embodiment, the second front surface 2*b*, on which the second illumination members 71B to 71Y are arranged, may face the carriage 20 when the carriage 20 is located at the home position. In FIGS. 2, 3, and 5, the carriage 20 is located at the home position.

As illustrated in FIG. 3, the ink tanks 50 mounted inside the carriage case 21 includes an ink tank 50B, an ink tank 50C, an ink tank 50M, and an ink tank 50Y in relation to the respective ink colors. More specifically, when the second front surface 2*b* of the main unit 10 is viewed from the front, the ink tank 50B for the black ink, the ink tank 50C for the cyan ink, the ink tank 50M for the magenta ink, and the ink tank 50Y for the yellow ink are arrayed in this order from the left.

In one embodiment, each of the ink tanks 50B to 50Y may have a hexahedral or boxed shape. The six surfaces of each of the ink tanks 50B to 50Y is referred to below as a front surface 50*a*, a back surface 50*b*, a left surface 50*c*, a right surface 50*d*, an upper surface 50*e*, and a lower surface 50*f*, as illustrated in FIG. 3.

The upper surfaces 50*e* of the ink tanks 50B to 50Y are provided with inlets 15 through which the corresponding inks are to be refilled. To plug up the inlets 15, caps 16, which serve as plug members, are detachably attached to the ends of the respective inlets 15. When the ink is refilled in one of the ink tanks 50, the cap 16 is detached from this ink tank 50, and then the ink refill bottle 14 is attached to the inlet 15 of the ink tank 50, as illustrated in FIG. 5.

As illustrated in FIG. 3, disposed near the upper surfaces 50*e* of the ink tanks 50B to 50Y and in back of the inlets 15 are a plurality of cap sensors 40. Each of the cap sensors 40 functions as a detector that detects whether the cap 16 is attached to or detached from a corresponding inlet 15. In one embodiment, each of the cap sensors 40 may be a push switch.

When a cap 16 is attached to an inlet 15, a piece 16*a* formed on the cap 16 pushes the lever of a corresponding cap sensor 40, and the cap sensor 40 detects the pushing of the lever. When the cap 16 is detached from the inlet 15, the cap sensor 40 detects that the piece 16*a* of the cap 16 stops pushing the lever of the cap sensor 40.

The push switches that implement the cap sensors 40B to 40Y in this embodiment are mounted on unillustrated circuit boards disposed on the upper surfaces 50*e* of the ink tanks 50B to 50Y. These circuit boards are connected, via signal wires, to an unillustrated flexible printed circuit (FPC) board on which patterns to which the driver for the recording head 11 is connected are formed. This FPC board is formed so as to extend or be bent in conjunction with the reciprocating of the carriage 20 along the X axis. Furthermore, a plurality of first illumination members 30 and ink amount sensors 41, details of which will be described later, are also connected to the FPC board. The FPC board is connected to a controller 80 disposed inside the main unit 10. Alternatively, the cap sensors 40B to 40Y, the first illumination members 30, and the ink amount sensors 41 may be connected to another independent FPC board via signal wires.

As illustrated in FIG. 4, the cap sensors 40 include: a cap sensor 40B mounted on the ink tank 50B for the black ink; a cap sensor 40C mounted on the ink tank 50C for the cyan ink; a cap sensor 40M mounted on the ink tank 50M for the magenta ink; and a cap sensor 40Y mounted on the ink tank 50Y for the yellow ink.

The carriage case 21 has a plurality of unillustrated inner partitions by which the ink tanks 50B to 50Y are separated from one another. Disposed on these inner partitions are ink amount sensors 41 that detect the remaining amounts of the inks contained in the respective ink tanks 50.

In one embodiment, as illustrated in FIG. 4, the ink amount sensors 41 may be disposed at the positions corresponding to 90%, 50%, and 10% of the maximum amount of the ink that can be contained in each of the ink tanks 50B to 50Y. The ink amount sensors 41 thus detect that the remaining amount of the ink in each of the ink tanks 50B to 50Y is equal to or more than 90%, in the range from 90% exclusive to 50% inclusive, in the range from 50% exclusive to 10% inclusive, or equal to or less than 10%.

As illustrated in FIG. 4, three ink amount sensors 41 are disposed in the centers, along the depth of the printer 1, namely, along the Y axis, of the right surface 50*d* and left surface 50*c* of each of the ink tanks 50B to 50Y, so that the three ink amount sensors 41 are arrayed vertically. In this case, light rays can pass through at least portions of the left surface 50*c* and the right surface 50*d* on which the ink amount sensors 41 are disposed.

The ink amount sensors 41 include: an ink amount sensor 41B disposed on the ink tank 50B for the black ink; an ink amount sensor 41C disposed on the ink tank 50C for the cyan ink; an ink amount sensor 41M disposed in the ink tank 50M for the magenta ink; and an ink amount sensor 41Y disposed in the ink tank 50Y for the yellow ink.

In one embodiment, each of the ink amount sensors 41B to 41Y, which may be a photosensor, includes a pair of first luminous element 41*a* and first light receiving element 41*b*, a pair of second luminous element 41*c* and second light receiving element 41*d*, and a pair of third luminous element 41*e* and third light receiving element 41*f*, as illustrated in FIG. 4. More specifically, the pair of first luminous element 41*a* and first light receiving element 41*b* is disposed at the position corresponding to 90% of the maximum amount of the ink in each of the ink tanks 50B to 50Y. When the first luminous element 41*a* emits light rays, the light rays pass through each of the ink tanks 50B to 50Y and then are received by the first light receiving element 41*b*. Likewise, the pair of second luminous element 41*c* and second light receiving element 41*d* is disposed at the position corresponding to 50% of the maximum amount of the ink in each of the ink tanks 50B to 50Y. When the second luminous element 41*c* emits light rays, the light rays pass through each of the ink tanks 50B to 50Y and then are received by the second light receiving element 41*d*. The pair of third luminous element 41*e* and third light receiving element 41*f* is disposed at the position corresponding to 10% of the maximum amount of the ink in each of the ink tanks 50B to 50Y. When the third luminous element 41*e* emits light rays, the light rays pass through each of the ink tanks 50B to 50Y and then are received by the third light receiving element 41*f*.

As illustrated in FIG. 3, the carriage case 21 is provided with the first illumination members 30, which function as illumination members that irradiate the upper surfaces 50*e* of the ink tanks 50B to 50Y. The first illumination members 30 are arranged on a wall surface 22 of the carriage case 21 near the back surfaces 50*b* of the ink tanks 50B to 50Y and disposed above the upper surfaces 50*e* of the ink tanks 50B to 50Y, so as to face the ink tanks 50B to 50Y.

The first illumination members 30 include four LEDs related to the ink tanks 50B to 50Y. In one embodiment, the first illumination members 30 may include: a first illumination member 30B related to the ink tank 50B for the black ink; a first illumination member 30C related to the ink tank 50C for the cyan ink; a first illumination member 30M related to the ink tank 50M for the magenta ink; and a first illumination member 30Y related to the ink tank 50Y for the yellow ink. As described above, the four first illumination members 30 are provided. The first illumination members 30B, 30C, 30M, and 30Y are arranged on the wall surface 22 in this order from the left in accordance with the arrangement of the ink tanks 50B to 50Y.

The LEDs that implement the first illumination members 30B to 30Y in this embodiment emit light rays, the colors of which are similar to those of the inks. More specifically, the LED that implements the first illumination member 30C related to the cyan ink emits blue rays. The LED that implements the first illumination member 30M related to the orange ink emits magenta rays. The LED that implements the first illumination member 30Y related to the yellow ink emits yellow rays. Exceptionally, the LED that implements the first illumination member 30B related to the black ink emits white rays. In short, the first illumination members 30B to 30Y basically emit light rays in accordance with the colors of the respective inks contained in the ink tanks 50B to 50Y. The manner in which the first illumination members 30B to 30Y operate will be described later.

As illustrated in FIG. 4, the printer 1 includes: the controller 80, formed of a central processing unit (CPU), for example, that controls all operations of components, including sensors, of the printer 1; and a memory 81 that stores various information. The printer 1 further includes: a light emitting element driver 82, a received light measurement section 83, an analog to digital (AD) converter 84, a first illumination member driver 85, and a second illumination member driver 86.

As an example, a description will be given below of operations that the components in FIG. 4 performs in response to a signal for requesting the check of the amounts of the inks contained in the ink tanks 50B to 50Y which is received through the operation panel 7. When receiving this request signal through the operation panel 7, the controller 80 instructs the light emitting element driver 82 to activate the ink amount sensors 41B to 41Y. More specifically, in response to the instruction, the light emitting element driver 82 applies a predetermined voltage to the first luminous elements 41*a*, the second luminous elements 41*c*, and the third luminous elements 41*e*, which constitute the ink amount sensors 41.

As a result of the above, the light emitting element driver 82 causes the first luminous elements 41*a*, the second luminous elements 41*c*, and the third luminous elements 41*e* to emit light rays, which then pass through the ink tanks 50B to 50Y.

In one embodiment, each of the first luminous elements 41*a*, the second luminous elements 41*c*, and the third luminous elements 41*e* may emit near-infrared rays. The reason is that a near-infrared ray has the higher transmittance than any other type of infrared ray. Beside, a near-infrared ray contains a large amount of infrared-ray component to be absorbed in the moisture of inks. Thus, using the near-infrared rays enables the first light receiving elements 41*b*, the second light receiving elements 41*d*, and the third light receiving elements 41*f* to generate large amounts of photo-currents, details of which will be described later. As a result, the first light receiving elements 41*b*, the second light receiving elements 41*d*, and the third light receiving elements 41*f* can reliably detect varying intensities of light rays emitted from the first luminous elements 41*a*, the second luminous elements 41*c*, and the third luminous elements 41*e*, respectively. Furthermore, using the near-infrared rays can reduce the influence of heat upon components contained in the inks, because a near-infrared ray applies no heat unlike any other type of infrared ray.

Following the above, the received light measurement section 83 causes the first light receiving elements 41*b*, the second light receiving elements 41*d*, and the third light receiving elements 41*f* to receive the near-infrared rays that have passed through the respective ink tanks 50B to 50Y. Then, an unillustrated analog amplifier converts photo currents generated by the first light receiving elements 41*b*, the second light receiving elements 41*d*, and the third light receiving elements 41*f* into an voltage signal and amplifies this signal. After that, the AD converter 84 converts the resulting signal into a digital signal and outputs this signal.

The memory 81 stores a program on which procedures of controlling the detection operation are described and a reference light amount for use in determining the remaining amounts of the inks. In this case, the reference light amount may be set to the amount of light that has passed through the ink in an ink tank 50.

As an example, the controller 80 may read, from the memory 81, the program for use in determining the remaining amounts of the inks in the ink tanks 50B to 50Y and the reference light amount, then compares the amounts of the near-infrared rays detected and the reference light amount, and determines the remaining amounts of the inks, based on the comparison result. More specifically, when the amount of infrared rays that have pass through an ink tank 50 is greater than the reference light amount, the controller 80 determines that the ink is not contained in the ink tank 50. When the amount of infrared rays is smaller than the reference light amount, the controller 80 determines that the ink is contained in the ink tank 50.

By performing the above determination process with the ink amount sensors 41B, 41C, 41M, and 41Y, the controller 80 detects the remaining amounts of the inks contained in ink tanks 50B, 50C, 50M, and 50Y.

After having detected the remaining amounts of the inks in ink tanks 50B, 50C, 50M, and 50Y, the controller 80 instructs the second illumination member driver 86 to indicate the detected amounts. In this case, the second illumination member driver 86 lights the second illumination members 71B, 71C, 71M, and 71Y in accordance with the remaining amounts of the inks detected.

In one embodiment, the second illumination members 71B to 71Y operate in any of four lighting states, in accordance with the remaining amounts of the inks in the ink tanks 50B to 50Y. More specifically, when the remaining amount of an ink is equal to or more than 90%, a corresponding second illumination member 71 lights in a first lighting state. When the remaining amount of an ink is in the range from 90% exclusive to 50% inclusive, the second illumination member 71 flashes in a second lighting state.

When the remaining amount of an ink is in the range from 50% exclusive to 10% inclusive, the second illumination member 71 flashes in a third lighting state. In this case, the second illumination member 71 flashes at a higher frequency than that in the above second lighting state. When the remaining amount of an ink is equal to or less than 10%, the second illumination member 71 flashes in a fourth lighting state. In this case, the second illumination member 71 flashes at a higher frequency than that in the above third lighting state.

The user visually checks the lighting states of the second illumination members 71B, 71C, 71M, and 71Y arranged on the second front surface 2*b* of the main unit 10, thereby grasping the remaining amounts of the inks in the ink tanks 50B, 50C, 50M, and 50Y.

Next, a description will be given of operations performed by the cap sensors 40B to 40Y and the first illumination member 30B to 30Y. For example, the user visually checks the lighting states of the second illumination members 71B to 71Y and grasps that the remaining amount of the black ink in the ink tank 50B is less than 10%. In this case, the user opens the upper cover 4 in order to refill the black ink in the ink tank 50B. In response, the carriage 20 moves to the home position.

When the user detaches the cap 16 from the ink tank 50B, the cap sensor 40B detects the detaching of the cap 16.

When the cap sensor 40B detects that the inlet 15 of the ink tank 50B for the black ink is exposed, the controller 80 instructs the first illumination member driver 85 to light the first illumination member 30B related to the ink tank 50B in accordance with the remaining amount of the black ink.

In one embodiment, the first illumination member 30B may operate in the same manner as that in which the second illumination members 71B to 71Y operate. Thus, the first illumination member 30B operates in any of the first to fourth lighting states, in accordance with the remaining amount of the ink in the ink tank 50B.

In this case, the first illumination member driver 85 causes the first illumination member 30B to operate in the fourth lighting state, which is related to the situation in which the remaining amount of the black ink is equal to or less than 10%. As a result, the first illumination member 30B flashes and irradiates a region, containing the inlet 15, on the upper surface 50*e* of the ink tank 50B for the black ink, so that this region becomes bright.

The user recognizes the flashing of the first illumination member 30B, thereby grasping the remaining amount of the black ink in the ink tank 50B. Then, the user attaches the ink refill bottle 14 to the inlet 15 and then refills the black ink in the ink tank 50B, as illustrated in FIG. 5.

In one embodiment, the first illumination member 30B may flash in response to the detaching of the cap 16 from the ink tank 50B, but the first illumination members 30C, 30M, and 30Y may be prohibited from flashing.

In one embodiment, the ink amount sensor 41B may continue to operate while the user is refilling the black ink. When the remaining amount of the black ink reaches 10% as a result of refilling the black ink from the ink refill bottle 14, the first illumination member 30B operates in the third lighting state, which is related to the situation in which the remaining amount of an ink is in the range from 50% exclusive to 10% inclusive.

When the remaining amount of the black ink reaches 50%, the first illumination member 30B operates in the second lighting state, which is related to the situation in which the remaining amount of an ink is in the range from 90% exclusive to 50% inclusive. Then, when the remaining amount of the black ink reaches 90%, the first illumination member 30B operates in the first lighting state, which is related to the situation in which the remaining amount of an ink is equal to or more than 90%.

Following the above, the user continues to refill the black ink in the ink tank 50B until the first illumination member 30B switches its lighting state from the second lighting state to the first lighting state, in which case the remaining amount of the black ink becomes equal to or more than 90%. Then, the user attaches the cap 16 to the inlet 15 of the ink tank 50B. When the cap sensor 40B detects the attaching of the cap 16, the first illumination member driver 85 causes the first illumination member 30B for the black ink to stop operating.

The operations of the cap sensor 40B and the first illumination member 30B for the black ink have been described. It is to be noted that the cap sensor 40C and the first illumination member 30C for the cyan ink, the cap sensor 40M and the first illumination member 30M for the magenta ink, and the cap sensor 40Y and the first illumination member 30Y for the yellow ink also operate in the same manner.

Next, a process of refilling an ink will be described below briefly. When the user detaches the cap 16 from one of the ink tanks 50B to 50Y, a corresponding one of the first illumination members 30B to 30Y operates in a lighting state related to the remaining amount of the ink. Then, the one of the first illumination members 30B to 30Y irradiates the upper surface 50*e* of the one of the ink tanks 50B to 50Y. After that, the user attaches the ink refill bottle 14 to the inlet 15, which is being irradiated by the one of the first illumination members 30B to 30Y.

While refilling the ink from the ink refill bottle 14, the user can continue to visually check the lighting state of the first illumination member 30B which depends on the remaining amount of the ink. After finishing refilling the ink, the user attaches the cap 16 to the inlet 15. In response, the first illumination member driver 85 finishes lighting the first illumination members 30B to 30Y. Then, the user closes the upper cover 4, after which the carriage 20 enters a standby state for the recording operation.

Effects of the printer 1 according to some embodiments of the present disclosure will be described below.

A printer 1 according to an embodiment of the present disclosure includes a main unit 10, a carriage 20, and a recording head 11; the recording head 11 functions as a recording unit. Both of the carriage 20 and the recording head 11 are disposed inside the main unit 10. The carriage 20 has a plurality of ink tanks 50 mounted above the recording head 11. Each of the ink tanks 50 contains an ink to be supplied to the recording head 11 and has an inlet 15 through which the ink is to be refilled from an ink refill bottle 14. Caps 16 plug up the respective inlets 15. A plurality of first illumination members 30 function as illumination members that irradiate the ink tanks 50 from their back surfaces. A plurality of cap sensors 40 function as detectors that detect detaching of the caps 16 from the inlets 15. A controller 80 controls the first illumination members 30, based on the detection results of the respective cap sensors 40. The first illumination members 30 light in response to the detections of the detaching of the caps 16 from the respective inlets 15 with the cap sensors 40. As a result, the first illumination members 30 irradiate upper surfaces 50*e* of the ink tanks 50. With this configuration, a user can easily find the inlet 15 of an ink tank 50 when refilling the ink in this ink tank 50, thereby reliably attaching the ink refill bottle 14 to the inlet 15.

In the above printer 1, the ink tanks 50 (50B, 50C, 50M, and 50Y) in the carriage 20 are related to the respective colors of four inks. The first illumination members 30, each of which functions as an illumination member, emit light rays with their colors related to those of the inks contained in the ink tanks 50B, 50C, 50M, and 50Y. For example, the first illumination members 30 may include first illumination members 30B, 30C, 30M, and 30Y: the first illumination member 30B for a black ink may emit white rays; the first illumination member 30C for a cyan ink may emit blue rays; the first illumination member 30M for a magenta ink may emit orange rays; and the first illumination member 30Y for a yellow ink may emit yellow rays. In short, the first illumination members 30B, 30C, 30M, and 30Y emit light rays, the colors of which are related to those of the inks contained in the ink tanks 50B, 50C, 50M, and 50Y, respectively. With this configuration, the user can easily understand the relationship between the colors of the inks and the ink tanks 50B, 50C, 50M, and 50Y containing these inks.

In the above printer 1, the first illumination members 30 operate in lighting states depending on the remaining amounts of inks contained in ink tanks 50B, 50C, 50M, and 50Y. When the remaining amount of the ink in an ink tank 50 is equal to or more than 90%, a corresponding first illumination member 30 operates in a first lighting state. When the remaining amount of the ink is in the range from 90% exclusive to 50% inclusive, the first illumination member 30 operates in a second lighting state. When the remaining amount of the ink is in the range from 50% exclusive to 10% inclusive, the first illumination member 30 operates in a third lighting state. When the remaining amount of the ink is less than 10%, the first illumination member 30 operates in a fourth lighting state. With this configuration, the user can easily grasp how much the inks are left in the ink tanks 50B, 50C, 50M, and 50Y.

The printer 1 further includes a plurality of second illumination members 71 (71B, 71C, 71M, and 71Y) arranged on a second front surface 2*b* of the main unit 10. The second illumination members 71B, 71C, 71M, and 71Y function as ink amount checkers 70 for use in checking the remaining amounts of the inks contained in the ink tanks 50B, 50C, 50M, and 50Y. The second illumination members 71 operate in the same manner as that in which the first illumination members 30 operates. With this configuration, the user can easily grasp how much the inks are currently left in the ink tanks 50B, 50C, 50M, and 50Y by visually checking the operations of the second illumination members 71B, 71C, 71M, and 71Y.

Second Embodiment

Figure 6:
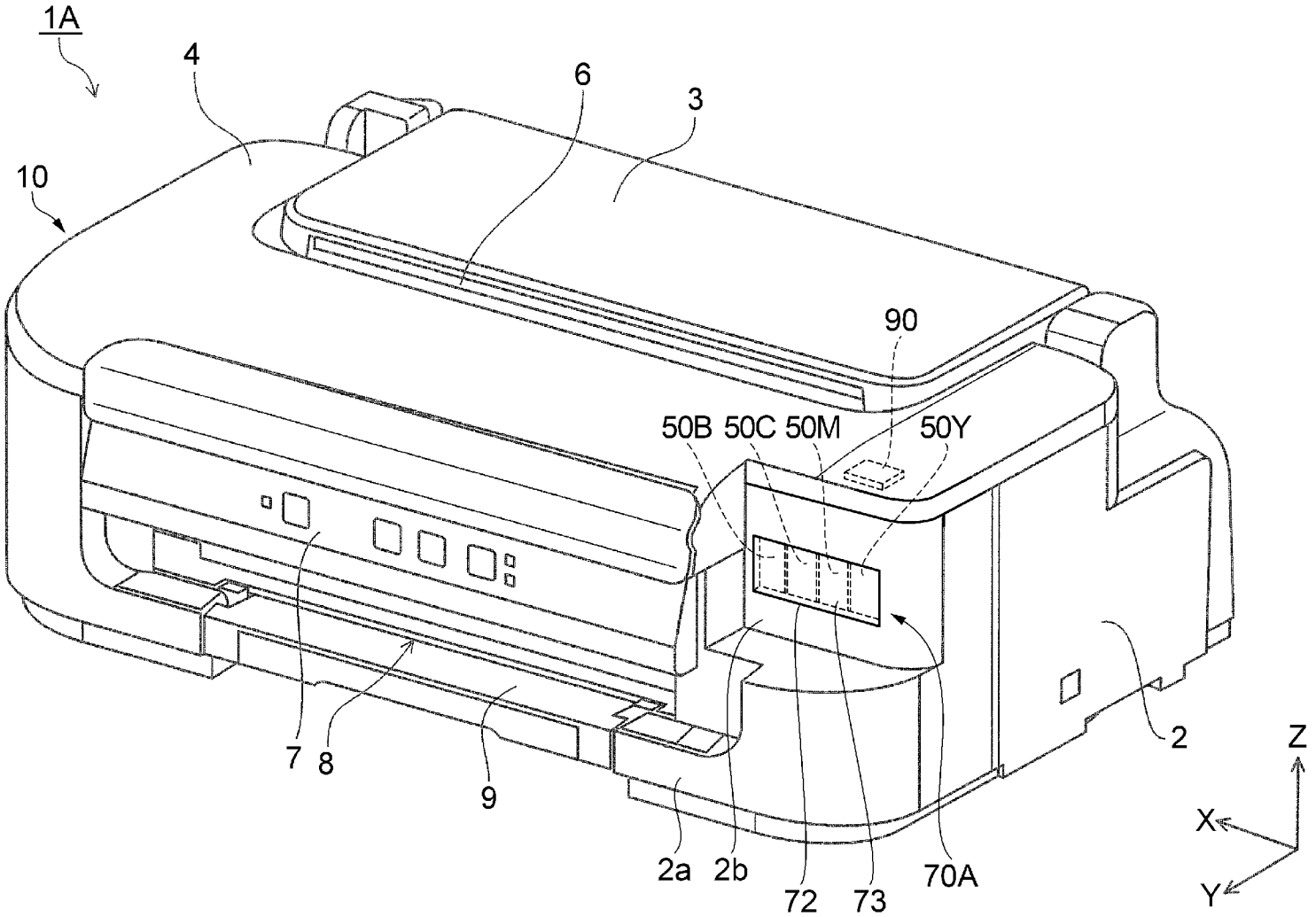
FIG. 6 illustrates, in perspective, the exterior of a printer according to a second embodiment of the present disclosure.

FIG. 6 illustrates, in perspective, the exterior of a printer 1A according to a second embodiment of the present disclosure, with a supply tray 3 closed.

The printer 1A differs from the foregoing printer 1, because an ink amount checker 70A differs in configuration from the ink amount checker 70, and a component equivalent to the second illumination member 71 is not provided. Other components are similar to those in the printer 1. It is to be noted that components of the printer 1A which are identical to those of the printer 1 are given the same characters and will not be described below.

As illustrated in FIG. 6, the ink amount checker 70A includes a rectangular opening 72 and a cover member 73, both of which are mounted on a second front surface 2*b* of a main unit 10. The cover member 73 attached to the opening 72 functions as a transparent member through which the opposite side is viewable. More specifically, when a carriage 20 is located at the home position, front surfaces 50*a* of four ink tanks 50B, 50C, 50M, and 50Y mounted in the carriage 20 are viewable through the ink amount checker 70A on the second front surface 2*b*.

In one embodiment, each of the ink tanks 50B to 50Y may have a hexahedral shape, and their surfaces are so clear that the user can visually check the remaining amounts of the inks in the ink tanks 50B, 50C, 50M, and 50Y from the outside. Disposed on the inner surface of the upper cover 4 near the home position and above the ink tanks 50B to 50Y is a third illumination member 90. In one embodiment, the third illumination member 90 may continue to light during the operation of the printer 1 and may be an LED that emits white rays. However, the third illumination member 90 does not necessarily have to continue to light, and alternatively may light in response to an operation of the operation panel 7.

After the user has opened an upper cover 4 and detaches a cap 16 in order to refill the inks in the ink tanks 50B, 50C, 50M, and 50Y, the cap sensor 40, the first illumination member 30, the ink amount sensor 41, and some other component perform the same operations as those in the first embodiment. Thus, the description of their operations will be skipped.

Effects of the printer 1A, configured above, according to the second embodiment will be described below.

A printer 1A according to an embodiment of the present disclosure includes an ink amount checker 70A formed by a cover member 73, which functions as a transparent member through which a user can visually check the remaining amounts of the inks. Thus, if the ink tanks 50B, 50C, 50M, and 50Y are all transparent, a user can visually check the remaining amounts of the inks in the ink tanks 50B, 50C, 50M, and 50Y through the cover member 73.

The printer 1A further includes a third illumination member 90 near the home position of a carriage 20 and above the ink tanks 50B, 50C, 50M, and 50Y. The third illumination member 90 irradiates the ink tanks 50B, 50C, 50M, and 50Y, thereby helping the user visually check the remaining amounts of the inks through the cover member 73.

The foregoing first and second embodiments of the present disclosure are not limitative and can be modified and varied in various ways. Some conceivable modifications will be described below.

First Modification

The printer 1 according to the first embodiment does not necessarily have to include the ink amount checker 70 formed of the second illumination members 71B to 71Y. If the printer 1 does not include the ink amount checker 70, for example, the controller 80 may activate the ink amount sensors 41B to 41Y in response to the detaching of the cap 16 from one of the ink tanks 50B to 50Y mounted in the carriage 20 after the open of the upper cover 4. Then, a corresponding one of the ink amount sensors 41B to 41Y may detect the remaining amount of the ink in the one of the ink tanks 50B to 50Y from which the cap 16 has been detached, namely, the inlet 15 has been exposed. Following this, the controller 80 may light a corresponding one of the first illumination members 30B to 30Y in accordance with the detected ink amount. This configuration also enables the first illumination members 30B to 30Y to irradiate the upper surfaces 50*e* of the ink tanks 50B to 50Y in response to the detaching of the caps 16 from the inlets 15.

Second Modification

As described above, the printer 1 according to the first embodiment does not necessarily have to include the ink amount checker 70 formed of the second illumination members 71B to 71Y. If the printer 1 does not include the ink amount checker 70, for example, the controller 80 may cause ink amount sensors 41B to 41Y to detect the remaining amounts of the inks in the ink tanks 50B to 50Y in response to the reception of a request for the detection through the operation of the operation panel 7 or in response to the open of a cover, such as the upper cover 4, disposed over the ink tanks 50B to 50Y. Then, the controller 80 may light the first illumination members 30B to 30Y, based on the detection result. This configuration enables the user to visually check the lighting states of the first illumination members 30B to 30Y and to determine in which ink tank 50 the ink should be refilled. When the user detaches the cap 16 from one of the ink tanks 50B to 50Y, a corresponding one of the first illumination members 30B to 30Y may light in accordance with the remaining amount of the ink, but the others may be prohibited from lighting. It is to be noted that the second modifications are also applicable to the printer 1A.

Third Modification

Both of the printer 1 according to the first embodiment and the printer 1A according to the second embodiment have four ink tanks 50 (50B to 50Y) for respective color inks. However, any number of ink tanks may be provided in the printer 1 or 1A in accordance with the number of color inks used. For example, if a single color ink is used in the printer 1 or 1A, a single ink tank may be provided. If four or more color inks are used in the printer 1 or 1A, four or more ink tanks may be provided.

Fourth Modification

In both of the printer 1 according to the first embodiment and the printer 1A according to the second embodiment, the first illumination members 30B to 30Y, each of which functions as the illumination member, irradiate the ink tanks 50B to 50Y from their back surfaces. However, the first illumination members 30B to 30Y may irradiate the ink tanks 50B to 50Y from any surface. Alternatively, the first illumination members 30B to 30Y may irradiate the ink tanks 50B to 50Y from their front or upper surfaces or two or more of their front, upper, and back surfaces.

Fifth Modification

In both of the printer 1 according to the first embodiment and the printer 1A according to the second embodiment, the first illumination members 30B to 30Y, each of which functions as the illumination member, emit four different colored rays in accordance with the colors of the inks. However, the first illumination members 30B to 30Y may emit any number of different colored rays. As an alternative example, the first illumination members 30B to 30Y may emit identical colored rays, independently of the colors of the inks. As another alternative example, a single first illumination member may emit mono-colored rays.

Sixth Modification

In both of the printer 1 according to the first embodiment and the printer 1A according to the second embodiment, as described above, the first illumination members 30B to 30Y, each of which functions as the illumination member, emit light rays with their colors related to four color inks. In short, the first illumination members 30B to 30Y emits light rays with different colors. Alternatively, each of the printers 1 and 1A may include a single first illumination member that emits different colored rays. In this case, for example, each of the printers 1 and 1A may include a single first illumination member that emits four different colored rays, instead of the first illumination members 30B to 30Y. When the user detaches the cap 16 from one of the ink tanks 50B to 50Y in order to refill the ink, the first illumination member may emit light rays with the color corresponding to that of the ink. In addition, the first illumination member may operate in a lighting state related to the remaining amount of the ink in the one of the ink tanks 50B to 50Y.

Seventh Modification

In both of the printer 1 according to the first embodiment and the printer 1A according to the second embodiment, the three ink amount sensors 41 are disposed on each of the ink tanks 50B to 50Y at the positions corresponding to 90%, 50%, and 10% of the maximum ink amount. Further, the ink amount sensors 41 detect whether the remaining amounts of the inks are equal or more than 90%, in the range from 90% exclusive to 50% inclusive, in the range from 50% exclusive to 10% inclusive, or less than 10%. However, the ink amount sensors 41 may be disposed at any given positions, in conformity with the design concept of each of the printers 1 and 1A.

Eighth Modification

In both of the printer 1 according to the first embodiment and the printer 1A according to the second embodiment, each of the first illumination members 30B to 30Y and the second illumination members 71B to 71Y operates depending on whether the remaining amount of the ink is equal or more than 90%, in the range from 90% exclusive to 50% inclusive, in the range from 50% exclusive to 10% inclusive, or less than 10%. However, each of the first illumination members 30B to 30Y and the second illumination members 71B to 71Y may operate in any lighting state as long as the user can easily grasp the remaining amounts of the inks.

Ninth Modification

In both of the printer 1 according to the first embodiment and the printer 1A according to the second embodiment, each of the ink amount sensors 41B to 41Y detects the remaining amount of the ink in a corresponding one of ink tanks 50B to 50Y at three positions. However, each of the ink amount sensors 41B to 41Y detects the remaining amount of the ink at any number of positions. Alternatively, each of the ink amount sensors 41B to 41Y detects the remaining amount of the ink at one, two, four, or more positions.

Tenth Modification

In both of the printer 1 according to the first embodiment and the printer 1A according to the second embodiment, the memory 81 stores the reference light amount for use in determining the presence of the ink in each of the ink tanks 50B to 50Y. This reference light amount is determined based on the intensity of light passing through a tank that contains ink. However, this reference light amount may be determined in any given manner. Alternatively, the reference light amount may be determined based on the intensity of light passing through an empty tank.

Eleventh Modification

In both of the printer 1 according to the first embodiment and the printer 1A according to the second embodiment, the ink amount sensors 41 detect the remaining amounts of the inks in response to an operation of the operation panel 7. However, the ink amount sensors 41 detect the remaining amounts of the inks in any given manner. Alternatively, the ink amount sensors 41 may detect the remaining amounts of the inks at regular time intervals.

Twelfth Modification

In both of the printer 1 according to the first embodiment and the printer 1A according to the second embodiment, the light rays emitted from the first luminous element 41*a*, the second luminous element 41*c*, and the third luminous element 41*e* of the ink amount sensors 41 that detect the remaining amounts of the inks pass through two surfaces of each of the ink tanks 50B to 50Y. For example, in the printer 1, the first luminous element 41*a* is disposed near the left surface 50*c* of each of the ink tanks 50B to 50Y, whereas the first light receiving element 41*b* is disposed near the right surface 50*d* of each of the ink tanks 50B to 50Y. When the first luminous element 41*a* emits light rays, the light rays pass through the left surface 50*c* and the right surface 50*d* in this order and then reaches the first light receiving element 41*b*. However, the light rays emitted from the first luminous element 41*a* may pass through any surfaces of each of the ink tanks 50B to 50Y. Alternatively, the first luminous element 41*a* may be disposed near the front surface 50*a* of each of the ink tanks 50B to 50Y, whereas the first light receiving element 41*b* may be disposed near the back surface 50*b* of each of the ink tanks 50B to 50Y. When the first luminous element 41*a* emits light rays, the light rays may pass through the front surface 50*a* and the back surface 50*b* in this order and then may reach the first light receiving element 41*b*.

Thirteenth Modification

In both of the printer 1 according to the first embodiment and the printer 1A according to the second embodiment, while the inks are being refilled in the ink tanks 50B to 50Y, the carriage 20 stays located at the home position. However, the carriage 20 may stay located at any other position.

Fourteenth Modification

In the printer 1A according to the second embodiment, the third illumination member 90 irradiates the ink tanks 50B to 50Y from the above. However, the third illumination member 90 does not necessarily have to irradiate the ink tanks 50B to 50Y. Alternatively, the first illumination members 30B to 30Y may irradiate the ink tanks 50B to 50Y instead of the third illumination member 90. This configuration can also help the user visually check the remaining amounts of the inks in the ink tanks 50B to 50Y through the cover member 73.

Contents derived from the foregoing first and second embodiments and their modifications will be described below.

A recording apparatus includes a main unit. A recording head that performs a recording operation by discharging a liquid onto a medium is disposed inside the main unit. A carriage that is movable in a direction intersecting a direction in which the medium is to be transported and that has a bottom on which the recording head is mounted is disposed inside the main unit. At least one liquid container that contains the liquid to be supplied to the recording head and that has an inlet through which the liquid is to be refilled from an ink refill bottle is mounted above the recording head in the carriage. A plug member plugs up the inlet. An illumination member irradiates the liquid container from one or more of a front surface, an upper surface, and a back surface of the liquid container. A detector (cap sensor 40) detects detaching of the plug member from the inlet. A controller controls the illumination member, based on a detection result of the detector. The illumination member is configured to irradiate the liquid container in response to detection of the detaching of the plug member from the inlet with the detector.

According to the above configuration, a recording apparatus includes a main unit. A recording head that performs a recording operation by discharging a liquid onto a medium is disposed inside the main unit. A carriage that is movable in a direction intersecting a direction in which the medium is to be transported and that has a bottom on which the recording head is mounted is disposed inside the main unit. At least one liquid container that contains the liquid to be supplied to the recording head and that has an inlet through which the liquid is to be refilled from an ink refill bottle is mounted above the recording head in the carriage. A plug member plugs up the inlet. An illumination member irradiates the liquid container from one or more of a front surface, an upper surface, and a back surface of the liquid container. A detector detects detaching of the plug member from the inlet. A controller controls the illumination member, based on a detection result of the detector. The illumination member is configured to irradiate the liquid container in response to detection of the detaching of the plug member from the inlet with the detector. As described above, the illumination member irradiates the liquid container in response to detection of the detaching of the plug member from the inlet with the detector. This can help a user find the inlet of the liquid container when refilling the liquid in the liquid container, thereby reliably attaching the ink refill bottle to the inlet.

In the above recording apparatus, the illumination member may emit a light ray, a color of which is related to a color of the liquid contained in the liquid container.

According to the above configuration, the illumination member may emit a light ray, a color of which is related to a color of the liquid contained in the liquid container. Consequently, the user can easily understand the relationship between the color of the liquid and the liquid container containing this liquid.

In the above recording apparatus, the illumination member may operate in a lighting state that depends on a remaining amount of the liquid contained in the liquid container.

According to the above configuration, the illumination member may operate in a lighting state that depends on a remaining amount of the liquid contained in the liquid container. Consequently, the user can easily grasp how much the ink is currently left in the liquid container.

In the above recording apparatus, the main unit may have a liquid amount checker for use in checking the remaining amount of the liquid contained in the liquid container.

According to the above configuration, the main unit may have a liquid amount checker for use in checking the remaining amount of the liquid contained in the liquid container. Consequently, the user can easily grasp how much the ink is currently left in the liquid container by visually checking the liquid amount checker.

In the above recording apparatus, the liquid amount checker may include a second illumination member that operates in a lighting state that depends on the remaining amount of the ink.

According to the above configuration, the liquid amount checker may include a second illumination member that operates in a lighting state that depends on the remaining amount of the ink. Consequently, the user can easily grasp how much the ink is currently left in the liquid container by visually checking the lighting state of the second illumination member.

In the above recording apparatus, the liquid amount checker may be formed of a transparent member that enables the remaining amount of the liquid to be visually checked.

According to the above configuration, the liquid amount checker may be formed of a transparent member that enables the remaining amount of the liquid to be visually checked. Consequently, the user can easily grasp how much the ink is currently left in the liquid container by visually checking the remaining amount of the liquid in the liquid container through the transparent member.

What is claimed is:

1. A recording apparatus comprising:

a recording head that performs a recording operation by discharging a liquid onto a medium;

a carriage that is movable in a direction intersecting a direction in which the medium is to be transported, the carriage having a bottom on which the recording head is mounted;

at least one liquid container that contains the liquid to be supplied to the recording head, the liquid container having an inlet through which the liquid is to be refilled, the liquid container being mounted above the recording head in the carriage;

a plug member that plugs up the inlet;

an illumination member that irradiates the liquid container from the liquid container;

a detector that detects detaching of the plug member from the inlet; and a controller that controls the illumination member, based on a detection result of the detector, the illumination member being configured to irradiate the liquid container in response to detection of the detaching of the plug member from the inlet with the detector.

2. The recording apparatus according to claim 1, wherein the illumination member emits a light ray, a color of which is related to a color of the liquid contained in the liquid container.

3. The recording apparatus according to claim 1, wherein the illumination member operates in a lighting state that depends on a remaining amount of the liquid contained in the liquid container.

4. The recording apparatus according to claim 1, wherein the main unit has a liquid amount checker for use in checking the remaining amount of the liquid contained in the liquid container.

5. The recording apparatus according to claim 4, wherein the liquid amount checker includes a second illumination member that operates in a lighting state that depends on the remaining amount of the ink.

6. The recording apparatus according to claim 4, wherein the liquid amount checker is formed of a transparent member that enables the remaining amount of the liquid to be visually checked.

* * * * *